US011944203B2

(12) United States Patent
Shih et al.

(10) Patent No.: US 11,944,203 B2
(45) Date of Patent: Apr. 2, 2024

(54) SOFA CUSHION OF CONVENIENT INSTALLATION AND REMOVAL

(71) Applicant: Chuan-Hang Shih, Changhua County (TW)

(72) Inventors: Chuan-Hang Shih, Changhua County (TW); Yu-Chi Yang, Changhua County (TW)

(73) Assignee: Chuan-Hang Shih, Lukang Township, Changhua County (TW)

( * ) Notice: Subject to any disclaimer, the term of this patent is extended or adjusted under 35 U.S.C. 154(b) by 0 days.

(21) Appl. No.: 17/682,551

(22) Filed: Feb. 28, 2022

(65) Prior Publication Data

US 2023/0270258 A1 Aug. 31, 2023

(51) Int. Cl.
*A47C 17/02* (2006.01)

(52) U.S. Cl.
CPC ..... *A47C 17/02* (2013.01)

(58) Field of Classification Search
CPC ..... A47C 17/02; A47C 17/04; A47C 4/06; A47C 4/30; A47C 5/06
USPC ..... 297/440.11
See application file for complete search history.

(56) References Cited

U.S. PATENT DOCUMENTS

| | | | | |
|---|---|---|---|---|
| 2,454,912 | A * | 11/1948 | Cunningham | A47C 7/56 297/411.42 |
| 6,588,840 | B1 * | 7/2003 | Lombardo | A47C 1/16 297/219.1 |
| 10,064,492 | B2 * | 9/2018 | Lobel | A47C 7/021 |
| 10,980,347 | B1 * | 4/2021 | Levin | A47C 4/02 |
| 2005/0225134 | A1 * | 10/2005 | Tseng | A47C 31/11 297/229 |
| 2015/0123439 | A1 * | 5/2015 | Jordan | A47C 31/113 297/228.1 |
| 2016/0066698 | A1 * | 3/2016 | Longshore | A47C 27/008 297/224 |
| 2022/0071398 | A1 * | 3/2022 | Brandtner | A47C 7/30 |

FOREIGN PATENT DOCUMENTS

CN 207015213 * 2/2018

* cited by examiner

*Primary Examiner* — Mark R Wendell
(74) *Attorney, Agent, or Firm* — MUNCY, GEISSLER, OLDS & LOWE, PC

(57) ABSTRACT

A sofa cushion adapted for being conveniently installed with or removed from a sofa frame includes a cushion member and a connection sleeve. The connection sleeve extends from a back side or a bottom side of the cushion member and has a first end with a first opening for enabling that the sofa frame is inserted into the connection sleeve through the first opening. Without the need of any tool, the sofa cushion can be installed with and removed from the sofa frame by a user herself/himself, and after the sofa cushion is installed with the sofa frame, the sofa cushion is firmly held with the sofa frame and not liable to move.

15 Claims, 3 Drawing Sheets

SOFA CUSHION OF CONVENIENT INSTALLATION AND REMOVAL

BACKGROUND OF THE INVENTION

1. Field of the Invention

The present invention relates generally to a sofa and more particularly, to a sofa cushion that can be conveniently installed with and removed from a sofa frame.

2. Description of the Related Art

To provide comfort, a sofa is usually equipped with one or more soft cushions made of foam material and/or having a large size, such as seating cushions, back supporting cushions, etc. These soft cushions may be directly placed on the sofa frame, resulting in that these cushions cannot be held in fixed positions. i.e., will always move from time to time when they are in use. To solve this problem, the cushions may be fixed to the sofa frame by sewing, resulting in inconvenience in replacement, cleaning and repair. When the cushion is partially damaged and cannot be removed from the sofa frame, it may be necessary to find a way to patch it, otherwise the entire sofa will have to be discarded. Therefore, how to balance the convenience of use and the stability of installation for a sofa cushion is an issue to be solved in the field of sofa manufacturing industry.

SUMMARY OF THE INVENTION

The present invention has been accomplished in view of the above-noted circumstances. It is an objective of the present invention to provide a sofa cushion, which can be conveniently installed with and removed from a sofa frame by a user himself/herself without the need of using any tool, and is structurally stable and not liable to move after it is installed.

To attain the above objective, the present invention provides a sofa cushion adapted for being conveniently installed with or removed from a sofa frame and comprising a cushion member and a connection sleeve. The connection sleeve extends from the cushion member and has a first end with a first opening for enabling that the sofa frame is inserted into the connection sleeve through the first opening. As a result, without the need of any tool, the sofa cushion can be installed with and removed from the sofa frame by a user herself/himself, and after the sofa cushion is installed with the sofa frame, the sofa cushion is firmly held with the sofa frame and not liable to move.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
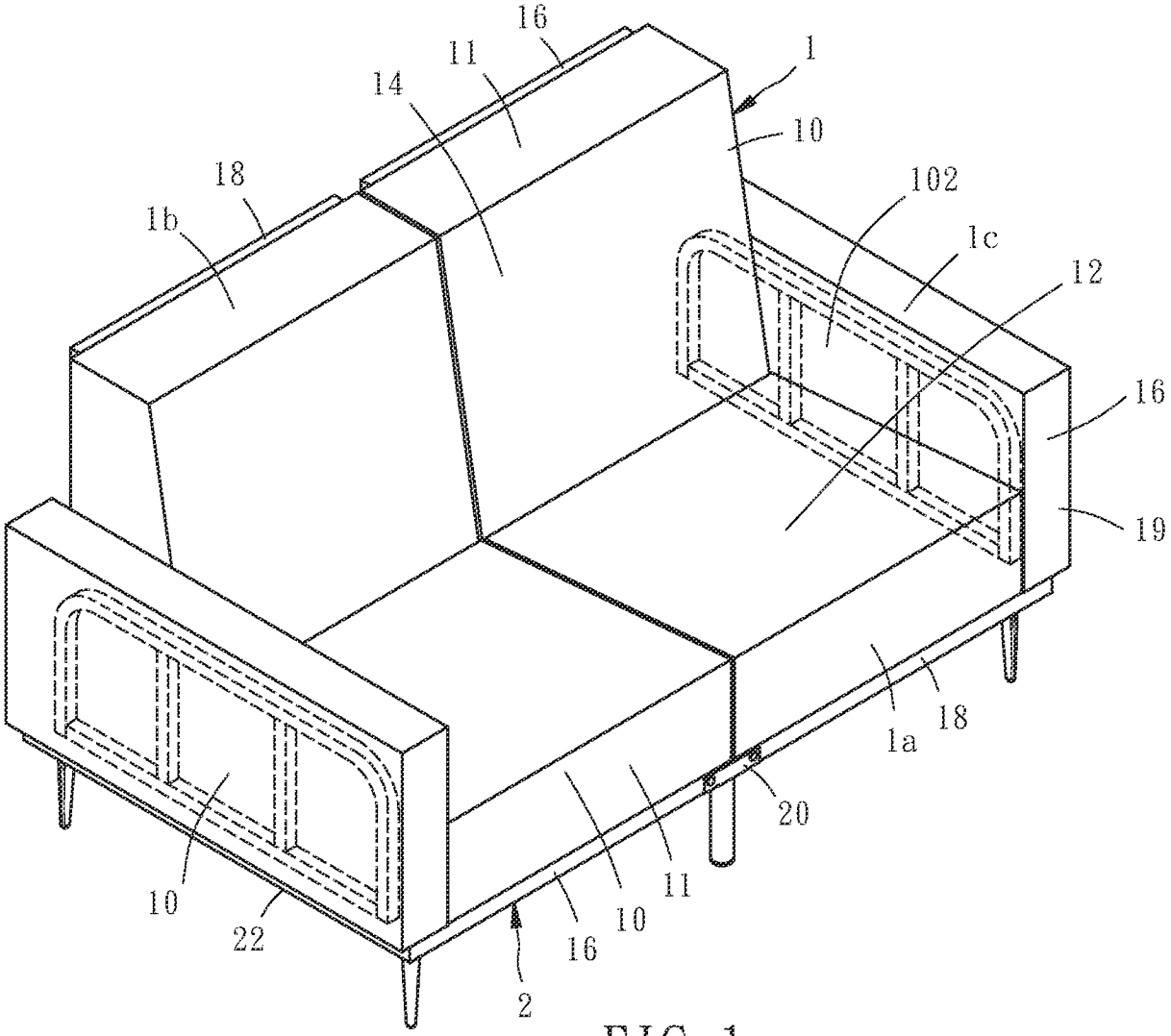
FIG. 1 is a perspective view showing that various sofa cushions of an embodiment of the present invention are installed with a sofa frame.
Figure 2:
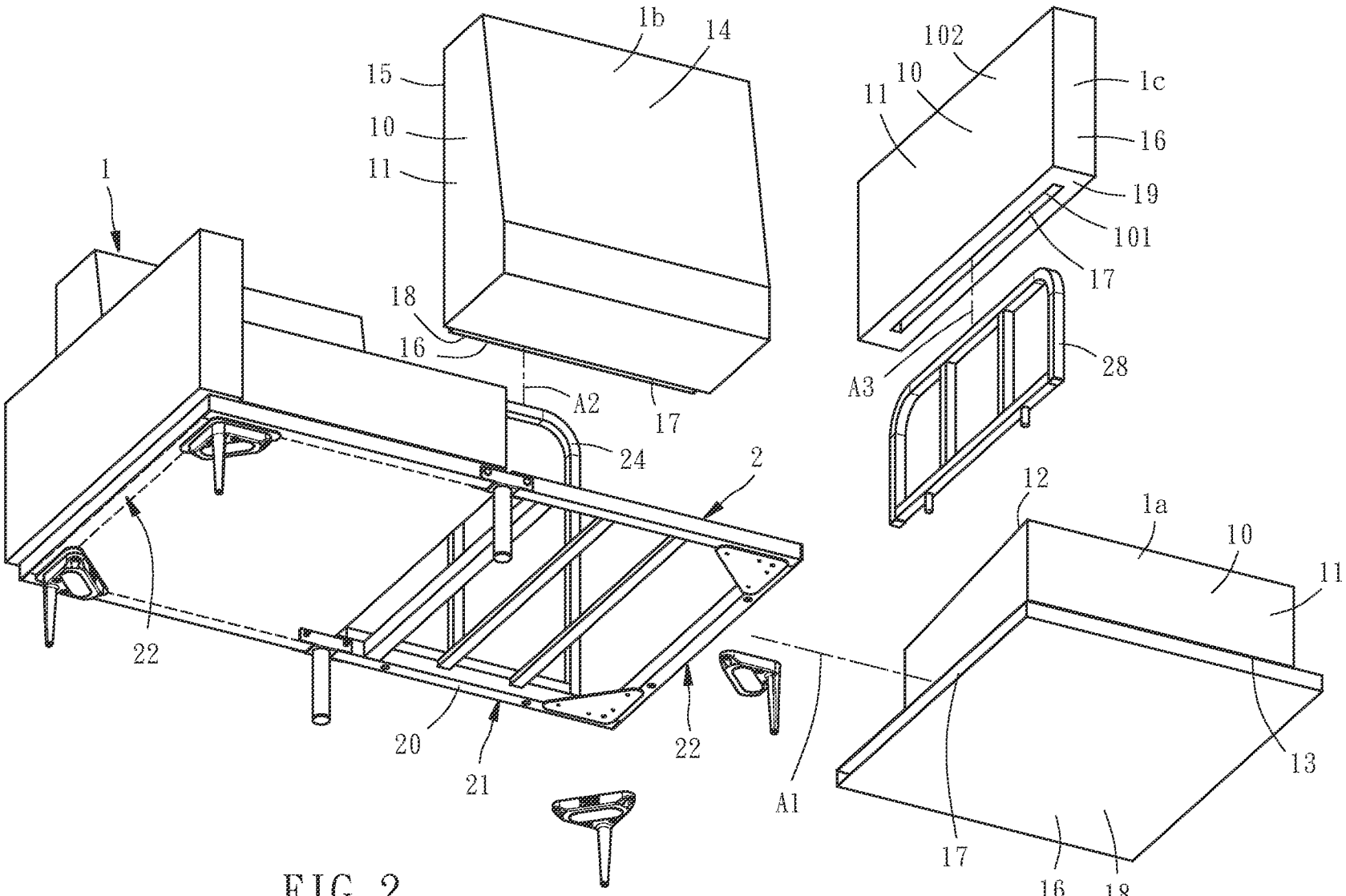
FIG. 2 is a partially exploded view of the sofa cushions and the sofa frame of FIG. 1.
Figure 3:
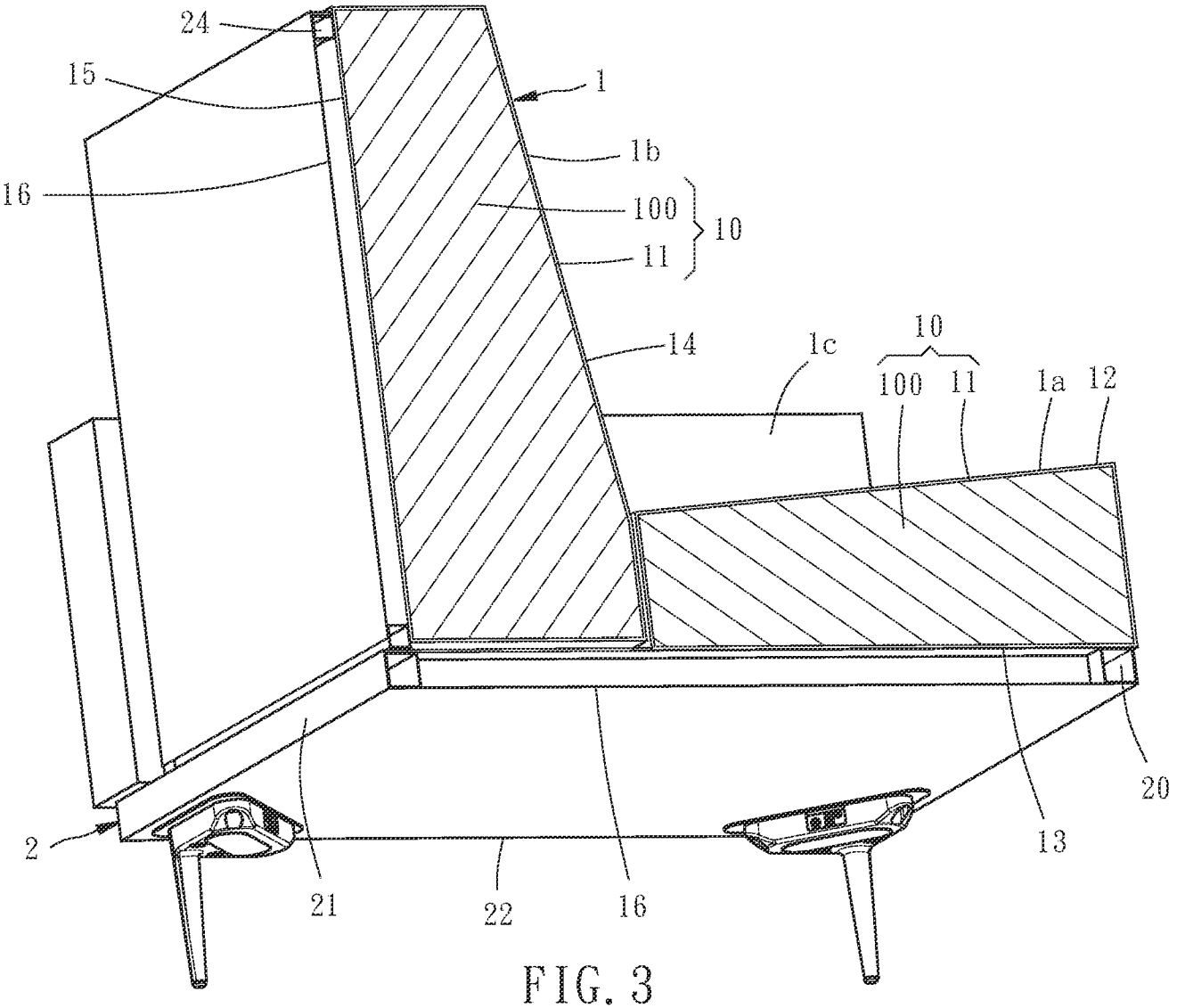
FIG. 3 is a sectional perspective view of FIG. 1.

The structure and technical features of the present invention will be detailedly described hereunder by an embodiment and accompany drawings. As shown in FIGS. 1-3, sofa cushions 1 provided in accordance with an embodiment of the present invention are installed with a sofa frame 2. In this embodiment, the sofa cushions 1 are realized as, but not limited to, a seating cushion 1*a*, a back supporting cushion 1*b*, and an armrest cushion 1*c*. Each sofa cushion 1 is composed of a cushion member 10 and a connection sleeve 16.

The cushion member 10 is composed of a core 100 and a cover fabric layer 11. The core 100 may be made of foam material for providing cushion effect, and the cover fabric layer 11 encases the core 100 therein.

The connection sleeve 16 extends from a side of the cushion member 10 and has a first end with a first opening 17, such that the sofa frame 2 can be inserted into the connection sleeve 16 through the first opening 17.

The sofa frame 2 constitutes a skeleton of the sofa, comprising a base 20 for supporting the user's weight, two back supporting racks 24 mounted to a rear side 21 of the base 20 for supporting user's back, and two armrest racks 28 respectively mounted to left and right sides 22 of the base 20 for supporting user's arms.

The structure of the cushion member 10 will be detailedly illustrated by taking the seating cushion 1*a* as an example. The cushion member 10 has a top side 12 and a bottom side 13 opposite to the top side 12. The connection sleeve 16 is disposed at the bottom side 13 and defined with an axial direction A1 parallel to the bottom side 13 and parallel to the left-and-right direction of the sofa. The first opening 17 is located at the left end of the connection sleeve 16 and faces laterally, i.e., faces towards the left side. The connection sleeve 16 is formed by an enclosed fabric layer 18. Through the first opening 17 of the connection sleeve 16, the base 20 can be inserted into the connection sleeve 16 from the left side thereof. The connection sleeve 16 is configured having a size slightly larger than that of the base 20, such that the connection sleeve 16 can be tightly sleeved onto and held with the base 20. As a result, without the need of any tool, the sofa cushion 1 can be installed with and removed from the sofa frame 2 by a user herself/himself, and after the sofa cushion 1 is installed with the sofa frame 2, the sofa cushion 1 is firmly held with the sofa frame 2 and not liable to move, thereby achieving the objective of the present invention. Further, because the first opening 17 faces towards the left side and the right end of the connection sleeve 16 is a closed end, the connection sleeve 16 can fully shelter the base 20 after the connection sleeve 16 is sleeved onto the base 20, thereby achieving the effect of visual simplicity and beauty. However, in another embodiment, the second end (right end) of the connection sleeve 16 may be provided with a second opening, such that the connection sleeve 16 can be installed on the sofa frame 2 through different directions.

Further, the structure of the cushion member 10 will be now detailedly illustrated by taking the back supporting cushion 1*b* as an example. The cushion member 10 has a front side 14 and a rear side 15 opposite to the front side 14. The connection sleeve 16 is disposed at the rear side 15 and defined with an axial direction A2 parallel to the rear side 15 and parallel to the up-and-down direction of the sofa. The first opening 17 is configured facing downwardly. The connection sleeve 16 is formed by an enclosed fabric layer 18. Through the first opening 17 of the connection sleeve 16, the back supporting rack 24 can be inserted into the connection sleeve 16 from the bottom side thereof. The connection sleeve 16 is configured having a size slightly larger than that of the back supporting rack 24, such that the connection sleeve 16 can be tightly sleeved onto and held with the back supporting rack 24. As a result, without the need of any tool, the sofa cushion 1 can be installed with and removed from the sofa frame 2 by a user herself/himself, and after the sofa cushion 1 is installed with the sofa frame 2, the sofa cushion 1 is firmly held with the sofa frame 2 and not liable to move, thereby achieving the objective of the present invention.

Moreover, the structure of the cushion member 10 will be again detailedly illustrated by taking the armrest cushion 1*c* at the right side as an example. The cushion member 10 has a right side 101 and a left side 102 opposite to the right side 101. The connection sleeve 16 extends outwardly from the right side 101 and is defined with an axial direction A3 parallel to the right side 101 and parallel to the up-and-down direction of the sofa. The first opening 17 is configured facing downwardly. The connection sleeve 16 is formed by an enclosed foam layer 19, such that the connection sleeve 16 itself provides a cushion effect. Through the first opening 17 of the connection sleeve 16, the armrest rack 28 can be inserted into the connection sleeve 16 from the bottom side thereof. The connection sleeve 16 is configured having a size slightly larger than that of the armrest rack 28, such that the connection sleeve 16 can be tightly sleeved onto and held with the armrest rack 28. As a result, without the need of any tool, the sofa cushion 1 can be installed with and removed from the sofa frame 2 by a user herself/himself, and after the sofa cushion 1 is installed with the sofa frame 2, the sofa cushion 1 is firmly held with the sofa frame 2 and not liable to move, thereby achieving the objective of the present invention.

To remove the sofa cushion 1, the user only needs to pull the sofa cushion 1 out of the sofa frame 2 in the direction reverse to the installation direction, without the need of any tool, for subsequent cleaning, repair, and/or replacement tasks. In other words, the sofa cushion 1 can be conveniently used. Based on the technical features of the present invention, various modifications to the sofa cushion 1 may be made. For example, the shape, the number of the connection sleeve 16 and/or the location of the opening may be changed in accordance actual need. Such variations are not to be regarded as a departure from the spirit and scope of the invention, and all such modifications as would be obvious to one skilled in the art are intended to be included within the scope of the following claims.

What is claimed is:

1. A sofa comprising a sofa frame and a sofa cushion installed with the sofa frame, the sofa cushion comprising:

a cushion member having a core made of foam material, and a cover fabric layer encasing the core therein; and a connection sleeve extending from the cover fabric layer of the cushion member and having a first end with a first opening such that the sofa frame is inserted into the connection sleeve through the first opening.

2. The sofa as claimed in claim 1, wherein the cushion member comprises a front side and a rear side opposite to the front side; the connection sleeve is disposed at the rear side and defined with an axial direction parallel to the rear side in a way that the first opening of the connection sleeve faces downwardly.

3. The sofa as claimed in claim 1, wherein the connection sleeve is sleeved onto a back supporting rack, a base or an armrest rack of the sofa frame.

4. The sofa as claimed in claim 1, wherein the connection sleeve is tightly sleeved onto and held with the sofa frame.

5. The sofa as claimed in claim 1, wherein the connection sleeve is formed by an enclosed fabric layer.

6. The sofa as claimed in claim 1, wherein the connection sleeve is formed by an enclosed foam layer.

7. A sofa cushion for being installed with a sofa frame, the sofa cushion comprising:

a cushion member having a core made of foam material, and a cover fabric layer encasing the core therein; and a connection sleeve extending from the cover fabric layer of the cushion member and having a first end with a first opening for enabling that the sofa frame is inserted into the connection sleeve through the first opening;

wherein the connection sleeve has a second end opposite to the first end and provided with a second opening.

8. The sofa cushion as claimed in claim 7, wherein the cushion member comprises a front side and a rear side opposite to the front side; the connection sleeve is disposed at the rear side and defined with an axial direction parallel to the rear side in a way that the first opening of the connection sleeve faces downwardly.

9. The sofa cushion as claimed in claim 8, wherein the connection sleeve is adapted for being sleeved onto a back supporting rack of the sofa frame.

10. The sofa cushion as claimed in claim 8, wherein the connection sleeve is formed by an enclosed fabric layer or an enclosed foam layer.

11. The sofa cushion as claimed in claim 7, wherein the connection sleeve is adapted for being sleeved onto a back supporting rack, a base or an armrest rack of the sofa frame.

12. The sofa cushion as claimed in claim 7, wherein the connection sleeve is formed by an enclosed fabric layer or an enclosed foam layer.

13. A sofa cushion for being installed with a sofa frame, the sofa cushion comprising:

a cushion member having a core made of foam material, and a cover fabric layer encasing the core therein; and a connection sleeve extending from the cover fabric layer of the cushion member and having a first end with a first opening for enabling that the sofa frame is inserted into the connection sleeve through the first opening;

wherein the cushion member comprises a top side and a bottom side opposite to the top side; the connection sleeve is disposed at the bottom side and defined with an axial direction parallel to the bottom side in a way that the first opening of the connection sleeve faces laterally.

14. The sofa cushion as claimed in claim 13, wherein the connection sleeve is adapted for being sleeved onto a base of the sofa frame.

15. The sofa cushion as claimed in claim 13, wherein the connection sleeve is formed by an enclosed fabric layer or an enclosed foam layer.

* * * * *